US010280556B2

(12) United States Patent
Javit et al.

(10) Patent No.: US 10,280,556 B2
(45) Date of Patent: May 7, 2019

(54) STEAM-SMOOTHING APPARATUS INCLUDING A BASE CONNECTED TO A SMOOTHING HEAD VIA A PIPE

(71) Applicant: SEB S.A., Ecully (FR)

(72) Inventors: Maxime Javit, Lyons (FR); Fang Sylor, Shanghai (CN); Li Wade, Shanghai (CN)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 15/770,050

(22) PCT Filed: Oct. 19, 2016

(86) PCT No.: PCT/FR2016/052696
§ 371 (c)(1),
(2) Date: Apr. 20, 2018

(87) PCT Pub. No.: WO2017/068279
PCT Pub. Date: Apr. 27, 2017

(65) Prior Publication Data

US 2018/0305855 A1 Oct. 25, 2018

(30) Foreign Application Priority Data

Oct. 23, 2015 (CN) ..... 2015 1 0724863
Oct. 23, 2015 (FR) ..... 15 60114

(51) Int. Cl.
*D06F 75/20* (2006.01)
*D06F 75/12* (2006.01)
*D06F 75/38* (2006.01)

(52) U.S. Cl.
CPC ..... *D06F 75/20* (2013.01); *D06F 75/12* (2013.01); *D06F 75/38* (2013.01)

(58) Field of Classification Search
CPC ..... D06F 73/00; D06F 87/00; D06F 87/12; D06F 87/20; D06F 87/24; D06F 87/36;
(Continued)

(56) References Cited

U.S. PATENT DOCUMENTS 2,664,653 A * 1/1954 Voskresenski ..... D06F 75/16 38/77.4
3,436,852 A * 4/1969 Stansbury ..... D06F 75/12 38/77.6

(Continued)

FOREIGN PATENT DOCUMENTS

EP 1559830 A1 * 8/2005
EP 2 336 421 A1 6/2011

(Continued)

OTHER PUBLICATIONS

International Search Report as issued in International Patent Application No. PCT/FR2016/052696, dated Jan. 25, 2017.

(Continued)

*Primary Examiner* — Ismael Izaguirre
(74) *Attorney, Agent, or Firm* — Pillsbury Winthrop Shaw Pittman LLP

(57) ABSTRACT

A steam-smoothing apparatus includes a base intended for producing a steam flow and connected to a smoothing head via a flexible pipe in which the steam produced by the base freely escapes to the smoothing head. The smoothing head includes a rear portion, forming a grasping handle, and a widened front portion including a surface provided with a plurality of steam outlet holes through which the flow of steam from the base is distributed. The widened front portion contains a first steam-dispensing chamber, which supplies steam to a first group of steam outlet holes, and a second steam-dispensing chamber which supplies steam to a second group of steam outlet holes. The smoothing head includes a system for blocking or reducing the steam flow (Continued)

towards the second group of steam outlet holes that can be actuated from outside the smoothing head.

20 Claims, 4 Drawing Sheets

(58) Field of Classification Search
CPC ..... D06F 87/38; A61H 33/12; A47G 25/72; D06C 7/00; F22B 1/30
See application file for complete search history.

(56) References Cited

U.S. PATENT DOCUMENTS 4,097,722 A * 6/1978 Soler ..... A45D 20/122 132/212
4,114,022 A * 9/1978 Braulke, III ..... A45D 20/00 132/212
4,206,340 A * 6/1980 Osrow ..... D06F 75/16 219/245
5,609,047 A 3/1997 Hellman et al.
6,212,332 B1 * 4/2001 Sham ..... D06F 75/12 38/77.6
2008/0061169 A1 3/2008 Copeland
2013/0219758 A1 * 8/2013 Jiang ..... D06F 73/00 38/144

FOREIGN PATENT DOCUMENTS

FR 2 912 429 A1 8/2008
FR 2 916 004 A1 11/2008

OTHER PUBLICATIONS

International Preliminary Report on Patentability and the Written Opinion of the International Searching Authority as issued in International Patent Application No. PCT/FR2016/052696, dated Apr. 24, 2018.

* cited by examiner

STEAM-SMOOTHING APPARATUS INCLUDING A BASE CONNECTED TO A SMOOTHING HEAD VIA A PIPE

CROSS-REFERENCE TO RELATED APPLICATIONS

This application is the U.S. National Stage of PCT/FR2016/052696, filed October 19, 2016, which in turn claims priority to French patent application number 1560114 filed October 23, 2015 and Chinese patent application number 201510724863.8 filed October 23, 2015.The content of these applications are incorporated herein by reference in their entireties.

This invention relates to a steam-smoothing apparatus comprising a base intended for producing a steam flow and connected to a smoothing head via a pipe in which the steam produced by the base freely escapes to the smoothing head. The invention relates more particularly to a steam-smoothing apparatus in which the smoothing head comprises a rear portion, forming a grasping handle, and a widened front portion comprising a surface provided with a plurality of steam outlet holes through which the flow of steam from the base is distributed.

From patent FR2912429, we know of a steam-smoothing apparatus comprising a base intended for producing a steam flow and connected by a pipe to a smoothing head in which the steam produced by the base freely escapes to the smoothing head. In this document, the smoothing head comprises a rear portion, forming a grasping handle, and a widened front portion comprising a surface provided with a plurality of steam outlet holes through which the flow of steam from the base is distributed.

Such a smoothing apparatus has the advantage of being inexpensive to manufacture and of quickly producing a saturating steam flow that permits very quickly smoothing curtains or clothes hung vertically on a hanger.

However, such a smoothing apparatus has a boiling chamber which provides the steam at atmospheric pressure, such that the speed of the steam flow at the outlet of the smoothing head is low, which is detrimental to proper penetration of the steam in thick fabrics. In addition, the low speed of the steam at the outlet of the smoothing brush does not permit good directivity of the steam jet in order to treat specific areas of clothing to be smoothed.

Also, one goal of this invention is to propose a smoothing apparatus that corrects these disadvantages and is very simple to construct.

For this purpose, the invention has the objective of a steam-smoothing apparatus comprising a base intended for producing a steam flow and connected to a smoothing head via a pipe in which the steam produced by the base freely escapes to the smoothing head, the smoothing head comprising a rear portion, advantageously cylindrical, forming a grasping handle, and a widened front portion comprising a surface provided with a plurality of steam outlet holes through which the flow of steam from the base is distributed, characterized in that the widened front portion encloses a first steam-dispensing chamber which supplies steam to a first group of steam outlet holes and a second steam-dispensing chamber which supplies steam to a second group of steam outlet holes, and in that the smoothing head comprises means for blocking or reducing the steam flow toward the second group of steam outlet holes, it being possible to activate these means from outside the smoothing head.

Such a steam-smoothing apparatus has the advantage of being simple and economical to make and of having a smoothing head that is very ergonomic to use, the smoothing head permitting quick treatment of textiles that are not thick and are highly steam permeable, because the steam is distributed gently to all steam outlet holes of the smoothing head. Such an apparatus also has the advantage of permitting the treatment of more precise areas and/or areas that are harder to smooth, by concentrating the steam flow at a limited number of steam holes of the smoothing head, so as to have a more powerful steam flow.

According to another characteristic of the invention, the pipe comprises an end connected to the base which communicates freely with a boiling chamber, and an end connected to the smoothing head which communicates freely with the first dispensing chamber.

Such a characteristic permits obtaining an apparatus that has a simple construction and does not use any means of controlling the emission of steam between the base and the smoothing head.

According to another characteristic of the invention, the smoothing head comprises a valve that is returned by return means to an open position permitting the passage of the steam flow toward the second steam-dispensing chamber, and the valve can be manually moved to a closed position in order to reduce or block the steam flow toward the second group of steam outlet holes.

Such a characteristic permits, through a device that is simple and economical to implement, obtaining a smoothing head in which the steam is by default distributed to all steam outlet holes of the smoothing head and, on command, is concentrated at only certain steam outlet holes when the user pushes a button.

According to another characteristic of the invention, the valve can be activated by a trigger arranged under the handle or by a circular wheel arranged around the grasping handle.

Such a characteristic permits obtaining good ergonomics of use.

According to another characteristic of the invention, the smoothing head comprises a flexible tube supplying steam to the second steam-dispensing chamber and a device for pinching the tube.

Such a characteristic represents an alternative in order to obtain, through a device that is simple and economical to implement, a steam flow that is concentrated at only the steam outlet holes in the first group when the user presses a button.

According to another characteristic of the invention, the device for pinching the tube comprises a button pivotally mounted on the smoothing head, the button being integral with an element that pinches the tube when the button is moved to a depressed position, the button being returned to a resting position by elastic return means.

According to another characteristic of the invention, the surface receiving the steam outlet holes is flat and has a generally triangular contour.

According to another characteristic of the invention, the steam outlet holes are distributed in a V on the surface of the smoothing head, the steam outlet holes arranged at the pointed end of the V being supplied with steam from the first dispensing chamber, and the other steam outlet holes being supplied by the second dispensing chamber.

According to yet another characteristic of the invention, the total number of steam outlet holes is greater than or equal to five holes.

Such a characteristic permits obtaining steam distribution to a sufficient number of steam outlet holes to ensure steam distribution to a large surface area in order to quickly treat textiles with sufficient steam permeability.

According to another characteristic of the invention, the first group of steam outlet holes comprises fewer than five steam outlet holes and preferably three steam outlet holes.

Such a characteristic permits obtaining a concentration of steam at only a few holes, for a more precise steam flow.

According to another characteristic of the invention, the grasping handle comprises a longitudinal end at which the pipe engages with the smoothing head and an opposite end at which the grasping handle is extended by the widened front portion.

Such a characteristic permits a smoothing head that is very easy to handle and ergonomic to use.

The objects, aspects, and advantages of this invention will be more fully understood in consideration of the following description of a particular embodiment of the invention, presented as a non-restrictive example, by referring to the attached drawings in which:

Only the elements necessary for understanding the invention have been represented. To facilitate reading of the drawings, the same elements bear the same references from one figure to the next.

FIGS. 1 to 5 represent a smoothing head 1 according to a first embodiment.

Figure 1:
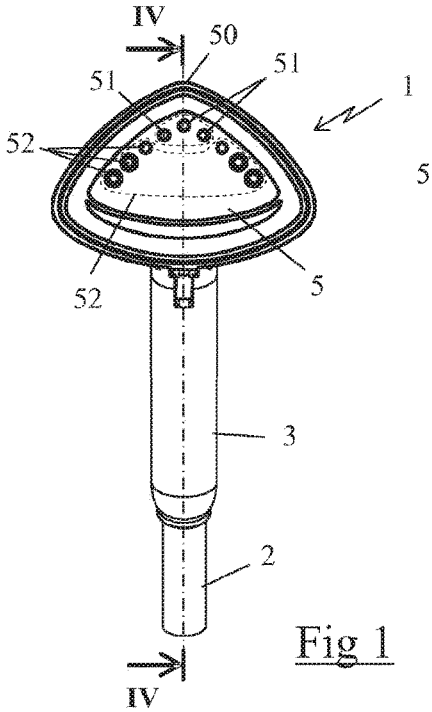
FIG. 1 is a front view of a smoothing head according to a first embodiment of the invention.
Figure 2:
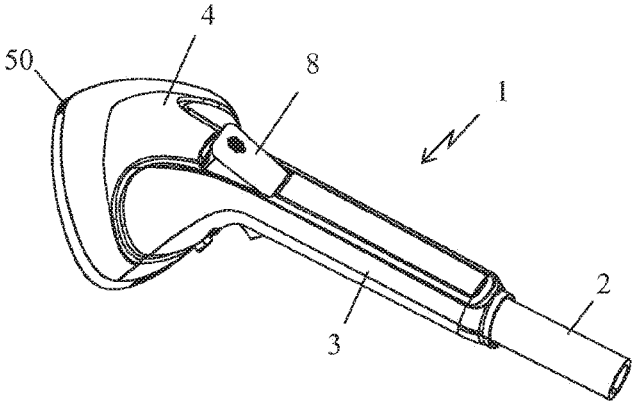
FIG. 2 is a perspective view of the smoothing head in FIG. 1.

The smoothing head 1 is connected by a flexible pipe 2 to a base, not shown in the figures and similar to that described in more detail in the patent application FR 2,912,429, the base comprising a water tank and a boiling chamber provided with a steam outlet opening directly connected to the pipe of the smoothing head.

The smoothing head 1 comprises a body comprising a cylindrical rear portion forming a grasping handle 3 and a widened front portion 4 in line with the longitudinal extension of the grasping handle 3. The widened front portion 4 comprises a flat surface 5 having a generally triangular contour, with curved edges, presenting a front point 50 in line with the longitudinal extension of the grasping handle 3, the flat surface 5 forming an angle of about 25° with the longitudinal direction of the grasping handle 3.

Figure 3:
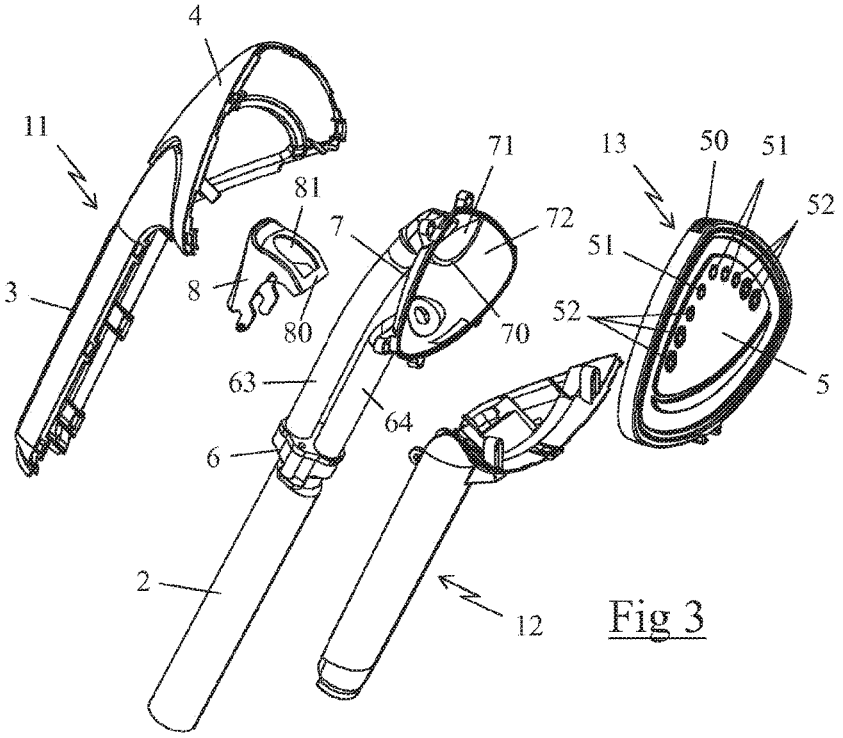
FIG. 3 is an exploded perspective view of the smoothing head in FIG. 1.

Preferably, the grasping handle 3 and the widened front portion 4 of the smoothing head 1 are formed by assembling two plastic half-shells 11, 12, visible in FIG. 3, and the flat surface 5 is supported by a soleplate 13, also made of plastic, which is snapped onto the two half-shells 11, 12.

According to FIG. 1, the flat surface 5 is provided with a first group of steam outlet holes 51, surrounded by dotted lines on FIG. 1, comprising three holes distributed in a V close to the front point 50 of the surface 5, and with a second group of steam outlet holes 52 comprising two times three holes arranged in line with the extension of the holes arranged in a V in the first group of steam outlet holes 51.

Figure 4:
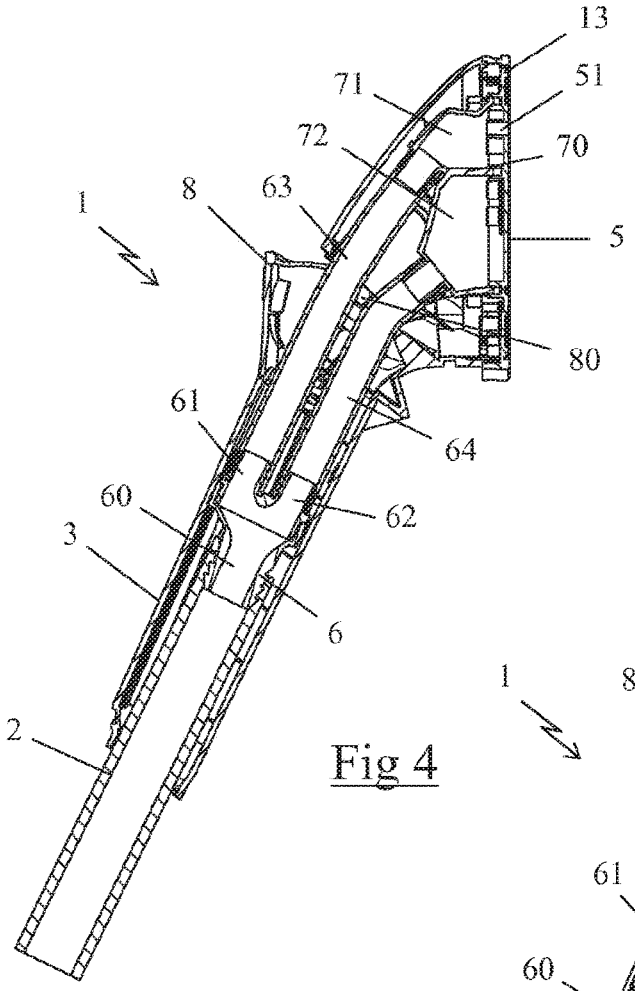
FIGS. 4 and 5 are longitudinal cross-sectional views of the smoothing head, according to line IV-IV of FIG. 1, when the button is in a relaxed position and a depressed position, respectively.

According to FIGS. 3 and 4, the flexible pipe 2 engages with the smoothing head 1 by the rear end of the grasping handle 3 and extends longitudinally inside the grasping handle up to a connection 6 dividing the steam flow from the flexible pipe 2 into two steam flows supplying the first group of steam outlet holes 51 and the second group of steam outlet holes 52, respectively.

For this purpose, the connection 6 comprises an inlet opening 60 to which the flexible pipe 2 is connected and comprises a first outlet opening 61 to which is connected a first flexible tube 63 connected to a first dispensing chamber 71 supplying only the first group of steam outlet holes 51. The connection 6 also comprises a second outlet opening 62 to which is connected a second flexible tube 64 connected to a second dispensing chamber 72 supplying only the second group of steam outlet holes 52.

Preferably, the first and second dispensing chambers 71, 72 are provided in a collector 7, arranged in the smoothing head 1, comprising a separating partition 70 extending between the first dispensing chamber 71 and the second dispensing chamber 72, the collector 7 advantageously consisting of a plastic part placed against the rear face of the soleplate 13 by being tightly connected to the latter.

More particularly according to the invention, the smoothing head 1 comprises a button 8 making it possible to reduce, or even block, the steam flow transmitted toward the second group of steam outlet holes 52, such that a larger portion of the steam flow produced by the base, or even all of this steam flow, is sent through the first group of steam outlet holes 51.

Figure 5:
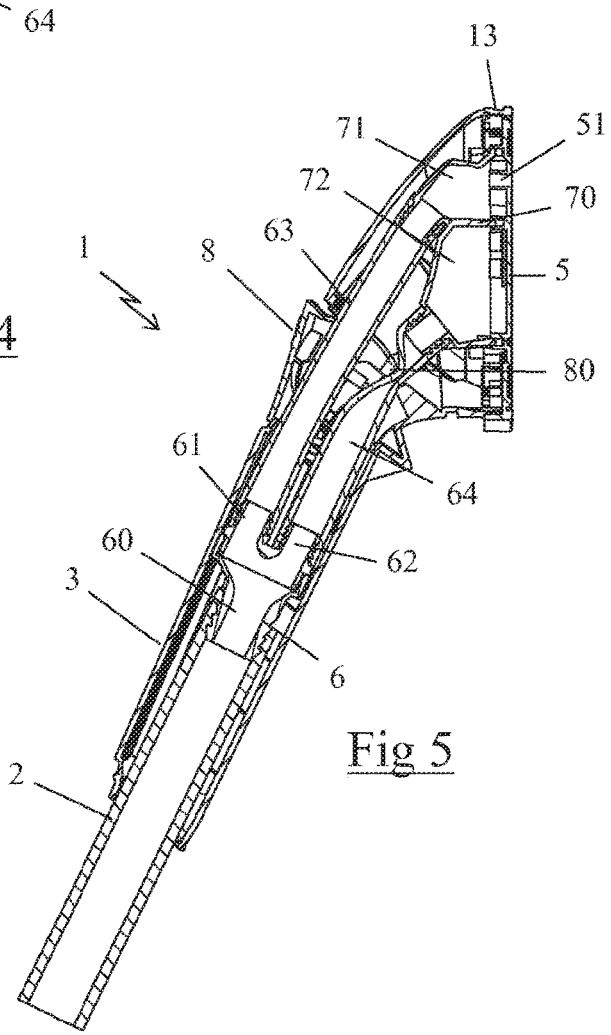
Figure 6:
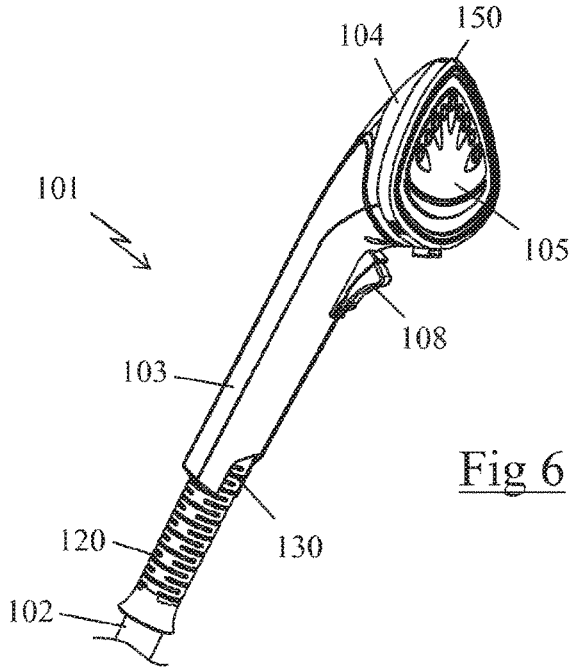
FIG. 6 is a perspective view of a smoothing head according to a second embodiment of the invention.

According to the first embodiment of the invention, the button 8 is pivotally mounted on the body of the smoothing head 1 and comprises a cross member 80 that pinches the second tube 64 when manual pressure is applied to the button 8, as illustrated in FIG. 5, the button 8 comprising an opening 81 above the cross member 80 to permit the free passage of the first tube 63.

The button 8 is advantageously arranged close to the front end of the grasping handle 3, on the upper face of the latter, and is returned to a resting position, illustrated in FIG. 4, by the elastic return realized by the second tube 64 when the latter is restored to its initial form when no pressure is applied to the button 8.

The smoothing head 1 thus made permits obtaining a concentration of steam flow only at the steam outlet holes 51 belonging to the first group, that is, those arranged close to the front point of the surface 5 when the user presses the button 8.

Such a concentration of steam flow at a limited number of holes has the advantage of making it possible to obtain a powerful and precise steam flow able to better target a particular area to be smoothed.

FIGS. 6 to 9 illustrate a smoothing head 101 according to a second embodiment, the smoothing head 101 being connected by a flexible pipe 102 to a base for steam generation conforming to that described for the first embodiment.

In this second embodiment, the smoothing head 101 comprises a body, similar to that described for the first embodiment, comprising a cylindrical rear portion forming a grasping handle 103 with which the flexible pipe 102 engages, and a widened front portion 104 in line with the longitudinal extension of the grasping handle 103 comprising a flat surface 105 provided with steam outlet holes.

In this embodiment, the smoothing head 101 comprises a device for protection of the flexible pipe 102, consisting of a deformable sleeve 120 enveloping the flexible pipe 102, at the rear end of the handle 103, the latter advantageously having a notch 130 on its lower face with which the deformable sleeve 120 may engage to facilitate the downward bending of the pipe.

Figure 7:
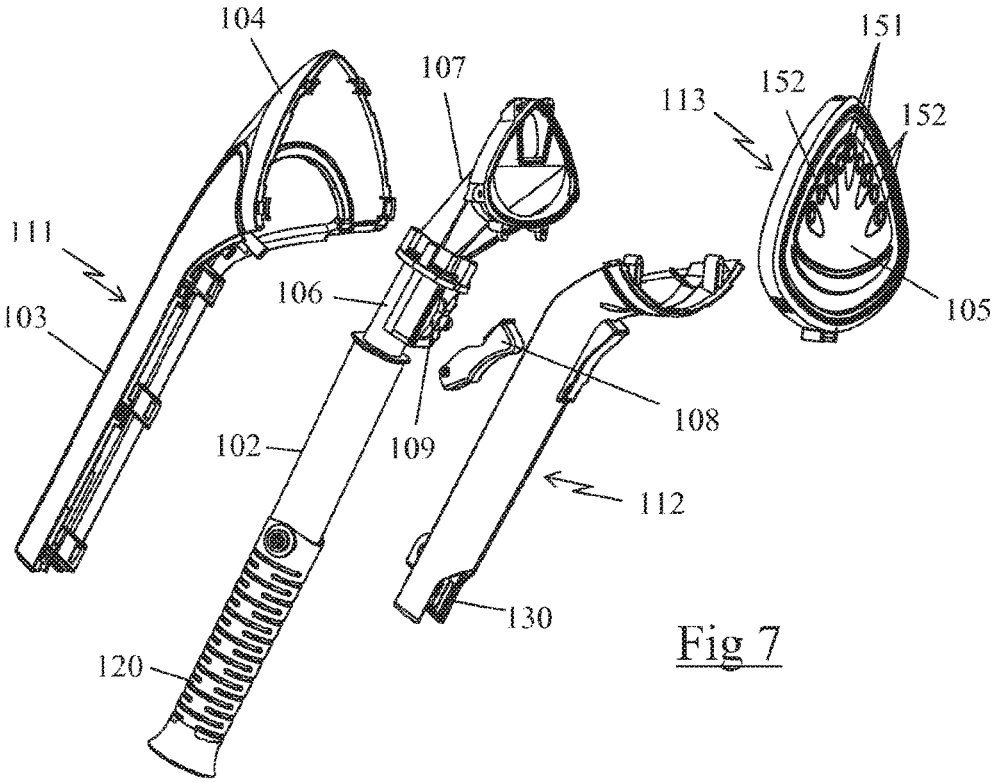
FIG. 7 is an exploded perspective view of the smoothing head in FIG. 6.

According to FIG. 7, the grasping handle 103 and the widened front portion 104 of the smoothing head are formed by assembling two plastic half-shells 111, 112 onto which a soleplate 113 is snapped, also made of plastic, supporting the surface 105, the soleplate 113 having a generally triangular contour, with curved edges, comprising a front point 150 in line with the longitudinal extension of the grasping handle 103.

Similarly to the first embodiment, the surface 105 is provided with a first group of steam outlet holes 151 comprising three holes distributed in a V close to the front point 150 of the surface 105, and with a second group of steam outlet holes 152 comprising two times three holes arranged in line with the extension of the holes arranged in a V in the first group of steam outlet holes 151.

Figure 8:
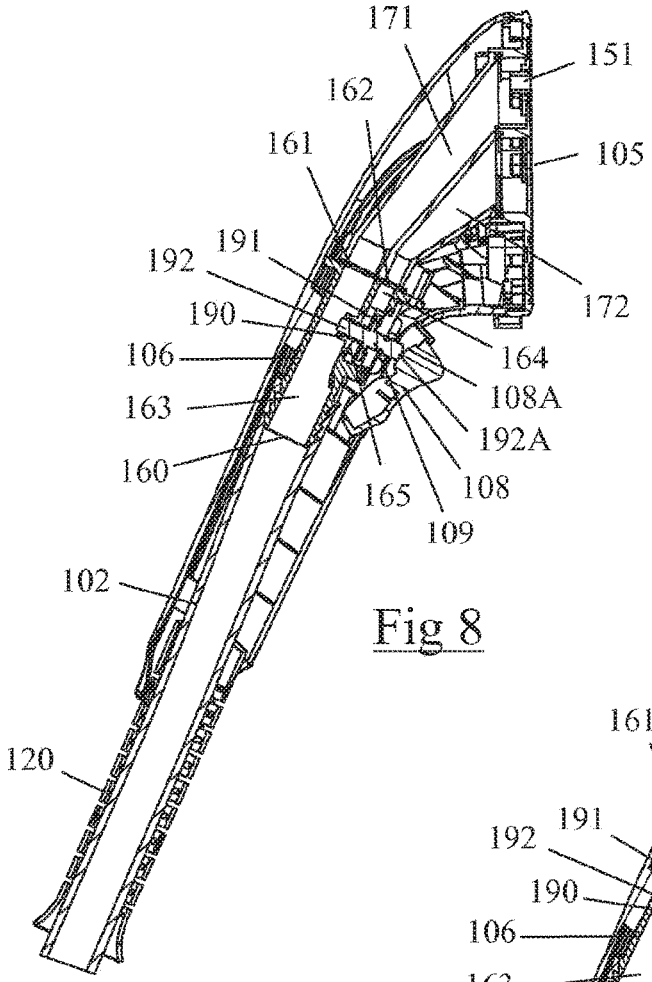
FIGS. 8 and 9 are longitudinal cross-sectional views of the smoothing head in FIG. 6 when the button is in a relaxed position and a depressed position, respectively.

According to FIGS. 7 and 8, the flexible pipe 102 extends longitudinally inside the grasping handle 103 up to a distributor 106 dividing the steam flow from the flexible pipe 102 into two steam flows supplying the first group of steam outlet holes 151 and the second group of steam outlet holes 152, respectively.

The distributor 106 comprises, on one side, a connection provided with an inlet opening 160 to which is connected the flexible pipe 102 and comprises, on the other side, a face provided with two outlet openings 161, 162 attached to which is a collector 107 made of plastic.

The collector 107 comprises a first dispensing chamber 171 extending opposite the first group of steam outlet holes 151, which is supplied with steam by one of the two outlet openings 161, 162, called the first outlet opening 161, and comprises a second dispensing chamber 172 supplied with steam by the other of the two outlet openings, called the second outlet opening 162, which extends opposite the second group of steam outlet holes 152.

More particularly according to this second embodiment, the distributor 106 comprises a main channel 163 which directly connects the first outlet opening 161 to the inlet opening 160 and comprises a derivation channel 164 which connects the second outlet opening 162 to an opening 165 leading to the main channel 163.

Figure 9:
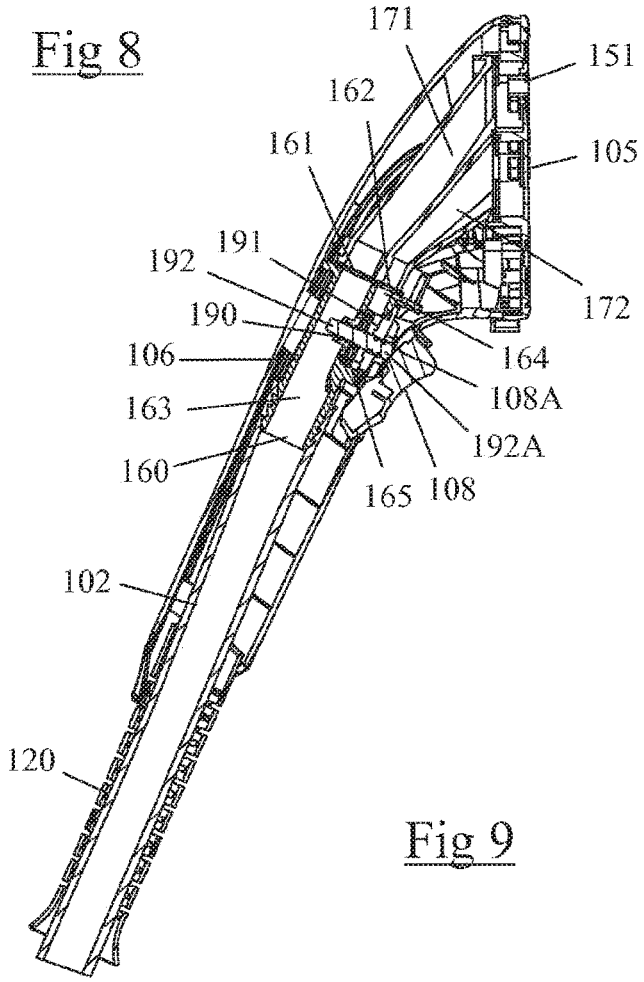

The opening 165 is provided with a valve 109 slidably mounted between an open position, illustrated in FIG. 8, to which it is automatically returned by a return spring 190, and a closed position, illustrated in FIG. 9, to which it is automatically brought by pressing a button 108 advantageously arranged on the lower face of the grasping handle 103, close to the front end of the latter.

The valve 109 comprises a disk provided with a peripheral seal 191 which rests at the edge of the opening 165 to hermetically close the latter when the valve 109 is in the closed position and comprises a central rod 192, integral with the disk, which is slidably mounted in the distributor 106, the rod 192 comprising an end 192A projecting outside the distributor 106.

The button 108, a trigger, is pivotally mounted on the body of the smoothing head 101 and comprises a cam 108A resting on the end 192A of the rod 192, pressure on the button 108 making it possible to bring the valve 109 into the closed position, illustrated in FIG. 9.

The smoothing head 101 thus made permits, just as for the first embodiment, obtaining a steam flow concentrated at the steam outlet holes 151 belonging to the first group, that is, those arranged close to the front point 150 of the surface 105 when the user presses the button 108.

Such a concentration of steam flow at a limited number of holes, close to the front point of the flat surface, has the advantage of making it possible to obtain a powerful and precise steam flow better able to target a particular area to be smoothed.

Such a construction thus permits, through a solution that is simple and economical to implement, improving the performances of an apparatus for vertical smoothing using a flow of steam.

In fact, the apparatus thus made permits rapid and efficient treatment of clothing made of highly steam-permeable fabric when the button is not activated, thanks to the distribution of steam through a high number of steam outlet holes covering a large treatment surface.

Conversely, when the user wishes to smooth clothing made of a fabric with low steam permeability, necessitating a higher steam flow speed, or when he wishes to treat a specific area of the clothing, he has only to press the button to obtain more powerful steam jets at a limited number of steam outlet holes.

In this way, we obtain an apparatus with greater versatility and efficiency in the treatment of clothing.

Of course, the invention is in no way limited to the embodiment described and illustrated, which has been provided only as an example. Modifications are still possible, in particular from the point of view of composition of the various components or by substitution of equivalent techniques, without departing from the scope of protection of the invention.

Thus, in an embodiment variant not represented, the steam flow toward the second group of steam outlet holes may be blocked by means of a pivotally mounted component.

Thus, in another embodiment variant not represented, the surface receiving the steam outlet holes may be curved.

Thus, in an embodiment variant not represented, the valve control button may consist of a circular wheel turning around the grasping handle.

The invention claimed is:

1. Steam-smoothing apparatus comprising a base intended for producing a flow of steam and connected to a smoothing head via a flexible pipe in which the steam produced by the base freely escapes to the smoothing head, the smoothing head comprising a rear portion forming a grasping handle, and a widened front portion comprising a surface provided with a plurality of steam outlet holes through which the flow of steam from the base is distributed, wherein the widened front portion encloses a first steam-dispensing chamber configured to supply steam to a first group of steam outlet holes and a second steam-dispensing chamber configured to supply steam to a second group of steam outlet holes, wherein the steam is separately supplied to the first steam-dispensing chamber and to the second steam-dispensing chamber from the flexible pipe, and wherein the smoothing head comprises means for blocking or reducing the steam flow toward the second group of steam outlet holes, said means being activable from outside the smoothing head.

2. The steam-smoothing apparatus according to claim 1, wherein the flexible pipe comprises an end connected to the base which communicates freely with a boiling chamber, and an end connected to the smoothing head which communicates freely with the first dispensing chamber.

3. The steam-smoothing apparatus according to claim 1, wherein the smoothing head comprises a valve that is returned by return means to an open position permitting a passage of the steam flow toward the second steam-dispensing chamber, said valve being manually movable to a closed position in order to reduce or block the steam flow in a direction of the second group of steam outlet holes.

4. The steam-smoothing apparatus according to claim 3, wherein, said valve is activable by a trigger arranged under the grasping handle or by a circular wheel arranged around the grasping handle.

5. The steam-smoothing apparatus according to claim 1, further comprising a flexible tube supplying steam to the second steam-dispensing chamber and a device for pinching the tube.

6. The steam-smoothing apparatus according to claim 5, wherein the device for pinching the tube comprises a button pivotally mounted on the smoothing head, the button being integral with an element that pinches the tube when the button is moved to a depressed position, the button being returned to a resting position by elastic return means.

7. The steam-smoothing apparatus according to claim 1, wherein the surface receiving the steam outlet holes is flat and has a generally triangular contour.

8. The steam-smoothing apparatus according to claim 1, wherein the steam outlet holes are distributed in a V on the surface of the smoothing head, the steam outlet holes arranged at a pointed end of the V being supplied with steam from the first dispensing chamber, and the other steam outlet holes being supplied by the second dispensing chamber.

9. The steam-smoothing apparatus according to claim 1, wherein a total number of steam outlet holes is greater than or equal to five holes.

10. The steam-smoothing apparatus according to claim 1, wherein the first group of steam outlet holes comprises fewer than five steam outlet holes.

11. The steam-smoothing apparatus according to claim 10, wherein the first group of steam outlet holes comprises three steam outlet holes.

12. The steam-smoothing apparatus according to claim 3, wherein said valve comprises a seal configured to hermetically close, in the closed position, an opening for supplying steam to the second group of steam outlet holes.

13. The steam-smoothing apparatus according to claim 1, further comprising a connector, the connector having a single inlet opening connected to an end of the flexible pipe and having two outlet openings for distributing the steam to the first steam-dispensing chamber and the second steam-dispensing chamber.

14. The steam-smoothing apparatus according to claim 1, wherein the flexible pipe extends in a longitudinal direction and into an inside of the grasping handle such that at least a portion of said grasping handle surrounds part of the flexible pipe, and wherein said means that is activable from outside the smoothing head is configured to move in a substantially perpendicular direction relative to the longitudinal direction of said flexible pipe.

15. Steam-smoothing apparatus comprising a base intended for producing a steam flow and connected to a smoothing head via a flexible pipe in which the steam produced by the base freely escapes to the smoothing head, the smoothing head comprising a rear portion forming a grasping handle and a widened front portion comprising a surface provided with a plurality of steam outlet holes through which the flow of steam from the base is distributed, the widened front portion enclosing a first steam-dispensing chamber configured to supply steam to a first group of steam outlet holes and a second steam-dispensing chamber configured to supply steam to a second group of steam outlet holes, wherein the apparatus further comprises a flexible tube supplying steam to the second steam-dispensing chamber and wherein the smoothing head comprising a device for pinching the flexible tube for blocking or reducing the steam flow toward the second group of steam outlet holes, said device being activable from outside the smoothing head.

16. The steam-smoothing apparatus according to claim 15, wherein the flexible pipe comprises an end connected to the base which communicates freely with a boiling chamber, and an end connected to the smoothing head which communicates freely with the first dispensing chamber.

17. The steam-smoothing apparatus according to claim 15, wherein the device for pinching the tube comprises a button pivotally mounted on the smoothing head, the button being integral with an element that pinches the tube when the button is moved to a depressed position, the button being returned to a resting position by elastic return means.

18. The steam-smoothing apparatus according to claim 15, wherein the surface receiving the steam outlet holes is flat and has a generally triangular contour.

19. The steam-smoothing apparatus according to claim 15, wherein the steam outlet holes are distributed in a V on the surface of the smoothing head, the steam outlet holes arranged at a pointed end of the V being supplied with steam from the first dispensing chamber, and the other steam outlet holes being supplied by the second dispensing chamber.

20. The steam-smoothing apparatus according to claim 15, wherein a total number of steam outlet holes is greater than or equal to five holes.

* * * * *